US006630783B1

(12) United States Patent
Ono

(10) Patent No.: US 6,630,783 B1
(45) Date of Patent: Oct. 7, 2003

(54) ELECTROLUMINESCENT PANEL WITH FOLDED LIGHT EMITTING BODY

(75) Inventor: Shinichirou Ono, Tokyo (JP)

(73) Assignee: NEC LCD Technologies, Ltd., Kawasaki (JP)

( * ) Notice: Subject to any disclaimer, the term of this patent is extended or adjusted under 35 U.S.C. 154(b) by 176 days.

(21) Appl. No.: 09/639,460

(22) Filed: Aug. 16, 2000

(30) Foreign Application Priority Data

Aug. 19, 1999 (JP) ..... 11-233197

(51) Int. Cl.[7] ..... H05B 33/00; H01J 1/62

(52) U.S. Cl. ..... 313/498; 313/500; 313/512

(58) Field of Search ..... 313/498, 500, 313/503, 504, 506, 509, 511, 512; 445/24

(56) References Cited

U.S. PATENT DOCUMENTS 3,252,035 A * 5/1966 Buck ..... 313/498
3,384,770 A * 5/1968 Vodicka ..... 313/509
3,497,750 A * 2/1970 Knochel et al. ..... 313/503
3,509,401 A * 4/1970 Calley et al. ..... 313/512
4,730,146 A * 3/1988 Maser et al.
4,914,348 A * 4/1990 Kameyama et al. ..... 313/509
5,120,618 A * 6/1992 Mori et al.
5,302,468 A * 4/1994 Namiki et al.
5,786,664 A * 7/1998 Liu ..... 313/506
6,091,192 A * 7/2000 Winsor ..... 313/493
6,124,672 A * 9/2000 Burke ..... 313/506

FOREIGN PATENT DOCUMENTS

JP 5-55494 7/1993

* cited by examiner

*Primary Examiner*—Ashok Patel
*Assistant Examiner*—Glenn D Zimmerman
(74) *Attorney, Agent, or Firm*—Katten Muchin Zavis Roseman

(57) ABSTRACT

An electroluminescent panel has a light emitting body sealed in an inner space between transparent package films, and the light emitting body includes a fluorescent layer, a transparent electrode formed on one surface of the fluorescent layer and formed of indium tin oxide and a back electrode formed on the other surface of the fluorescent layer and formed of aluminum, wherein the light emitting body is folded down so that a non-transparent conductive layer of silver is patterned on the transparent electrode of the folded portion, thereby enhancing the uniformity of brightness by virtue of the light radiated from the folded portion.

5 Claims, 9 Drawing Sheets

ELECTROLUMINESCENT PANEL WITH FOLDED LIGHT EMITTING BODY

FIELD OF THE INVENTION

This invention relates to an electroluminescent device and, more particularly, to an electroluminescent panel for emitting light through the electroluminescence and a lighting device using the electroluminescent panel.

DESCRIPTION OF THE RELATED ART

A typical example of the electroluminescent panel is shown in FIG. 1 of the drawings. The prior art electroluminescent panel largely comprises a transparent package films 6 and light emitting body. The transparent package films 6 are laminated on each other, and are bonded to each other along the periphery 7 thereof (see FIG. 2). As a result, an inner space is defined between the transparent package films 6, and the light emitting body is provided in the inner space.

The light emitting body includes a non-transparent back electrode 1, a transparent electrode 2 and a fluorescent layer 3. The transparent electrode 2 is formed on the front surface of the fluorescent layer 3, and the back surface of the fluorescent layer 3 is covered with the non-transparent back electrode 1. The transparent electrode 2 is formed of indium tin oxide, and the back electrode 1 is formed of conventional conductive metal. When the transparent electrode 2 is biased with respect to the non-transparent back electrode 1, the fluorescent layer 3 emits light as indicated by arrow in FIG. 2.

The electric power is supplied through a pair of power supply lines 4 to the transparent/back electrodes 2/1. One of the power supply lines 4 is directly connected to the back electrode 1. The other of the power supply lines 4 is connected to a non-transparent power feeding layer 5, which is held in contact with the transparent electrode 2. The non-transparent power feeding layer 5 is formed of silver paste. The non-transparent power feeding layer 5 is patterned like capital letter "I", and extends along a side line of the transparent electrode 2. The reason why the non-transparent power feeding layer 5 is required is that the silver paste is much smaller in resistivity than the indium tin oxide. If the power supply line 4 is directly connected to the transparent electrode 2, the potential level is decreased on the transparent electrode 2, and the light emitting body loses the brightness inversely proportional to the distance from the contact point between the power supply line 4 and the transparent electrode 2 as shown in FIG. 3. The non-transparent power feeding layer 5 makes the transparent electrode 2 equal in potential level along the side line, and the gradation is moderated (see FIG. 4). Thus, the non-transparent power feeding layer 5 is desirable for the light emitting body in so far as the highly-resistive non-transparent electrode 2 is used for the light emitting body. However, the non-transparent power feeding layer 5 makes the light emitting surface narrow. In other words, dark area takes place in the prior art electroluminescent panel from the inner edge of the non-transparent power feeding layer 5 to the outer edge of the transparent package film 6 as indicated by hatching lines in FIG. 1.

If the non-transparent power feeding layer 5 is patterned like capital letter "L", i.e., extending along two end lines of the transparent electrode 2, the gradation is further moderated. However, the dark area is widened. Thus, there is a trade-off between the gradation of brightness and the dark area. Research and development efforts have been made for an electroluminescent panel free from the problems. A solution is disclosed in Japanese Utility Model Publication of Unexamined Application No. 5-55494. The prior art electroluminescent panel disclosed therein has a light emitting body wrapped in package films. The light emitting body includes a fluorescent layer sandwiched between a transparent electrode and a back electrode. A difference from the light emitting body shown in FIG. 2 is an elongated transparent electrode. Although the side line of the transparent electrode 2 is aligned with the side line of the fluorescent layer 3, the transparent electrode of the light emitting body extends over the side line of the fluorescent layer, and is folded down under the back electrode. A power supply lead is held in contact with the back electrode, and the back electrode and the power supply lead are covered with a water absorbing layer. The folded portion of the transparent electrode is held in contact with the water absorbing layer. A non-transparent conductive metallic layer is patterned on the folded portion of the transparent electrode, and a power supply lead is connected to the non-transparent conductive metallic layer. Thus, both of the transparent electrode and the back electrode are located on the same side with respect to the fluorescent layer, and any non-transparent layer is not formed on the transparent electrode over the fluorescent layer. When a bias voltage is applied between the transparent electrode and the back electrode, the light emitting body radiates light through the transparent electrode and the package film to the outside thereof. There is not any obstacle on the optical path from the light emitting body toward the outside. This results in that the dark area is narrowed.

However, a problem is encountered in the prior art electroluminescent panel disclosed in the Japanese Utility Model Publication of Unexamined Application in that the periphery of the package films is still dark. When the prior art electroluminescent panels are arrayed for forming a back light source for a panel display, plural prior art electroluminescent panels are contiguous to one another at the peripheral areas, and dark area takes place like a net.

SUMMARY OF THE INVENTION

It is therefore an important object of the present invention to provide an electroluminescent panel, the peripheral area of which is bright.

It is also an important object of the present invention to provide a lighting device implemented by an array of the electroluminescent panels.

To accomplish the object, the present invention proposes to sideward radiate light from a folded portion of a light emitting body.

In accordance with one aspect of the present invention, there is provided an electroluminescent panel comprising a package having an inner space, a light emitting body accommodated in the inner space and including a fluorescent layer for emitting light, a high-conductive non-transparent electrode formed on one major surface of the fluorescent layer and a low-conductive transparent electrode formed on the other major surface of the fluorescent layer, at least a part of the fluorescent layer and an associated part of the low-conductive transparent electrode being folded so as to overlap the aforesaid one major surface therewith, and a power supply system including a first power supply lead connected to the high-conductive non-transparent electrode, a high-conductive power feeding layer formed on the associated part of the low-conductive transparent electrode and a second power supply lead connected to the high-conductive power feeding layer.

In accordance with another aspect of the present invention, there is provided a lighting device comprising plural electroluminescent panels for providing light emitting surface, and each of the electroluminescent panels comprising a package having an inner space, a light emitting body accommodated in the inner space and including a fluorescent layer for emitting light, a high-conductive non-transparent electrode formed on one major surface of the fluorescent layer and a low-conductive transparent electrode formed on the other major surface of the fluorescent layer, at least a part of the fluorescent layer and an associated part of the low-conductive transparent electrode being folded so as to overlap the aforesaid one major surface therewith and a power supply system including a first power supply lead connected to the high-conductive non-transparent electrode, a high-conductive power feeding layer formed on the associated part of the low-conductive transparent electrode and a second power supply lead connected to the high-conductive power feeding layer.

BRIEF DESCRIPTION OF THE DRAWINGS

The features and advantages of the electroluminescent panel and the lighting device will be more clearly understood from the following description taken in conjunction with the accompanying drawings in which.

DESCRIPTION OF THE PREFERRED EMBODIMENTS

Electroluminescent Panel

First Embodiment

Figure 5:
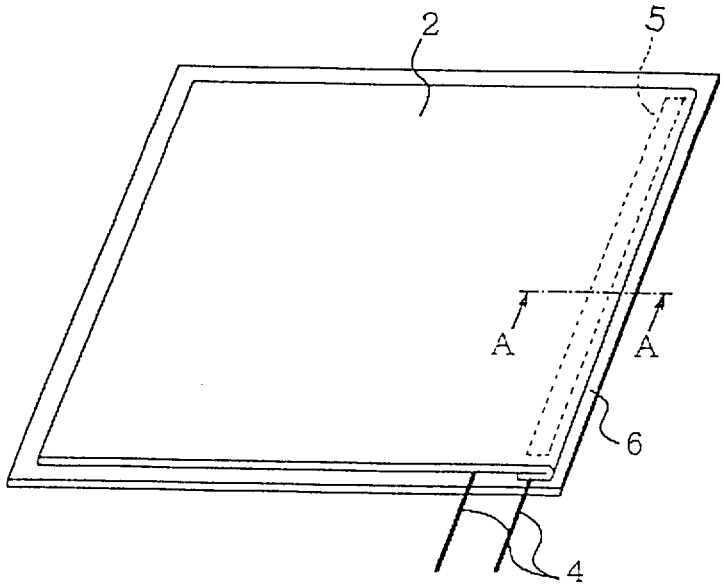
FIG. 5 is a perspective view showing an electroluminescent panel according to the present invention.
Figure 6:
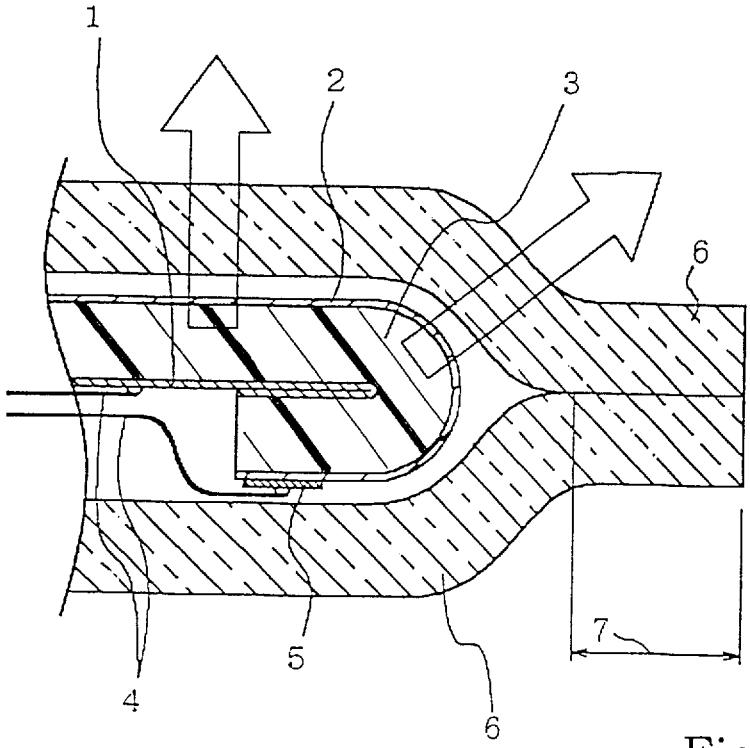
FIG. 6 is a cross sectional view taken along line A—A of FIG. 5 and showing the structure of the electroluminescent panel.

Referring to FIGS. 5 and 6 of the drawings, an electroluminescent panel embodying the present invention largely comprises a pair of package films 6, a light emitting body and a power supply system. One of the package films 6 is removed from the electroluminescent panel shown in FIG. 5 for clearly showing the light emitting body. The package films 6 are formed of synthetic resin, and are transparent. The package films 6 are bonded to one another along the periphery 7 thereof, and define an inner space (see figure 6). The package films 6 are moisture proof, and prevent the inner space from water and water vapor.

The light emitting body includes a back electrode 1, a transparent electrode 2 and a fluorescent layer 3, and wider than the inner space. In order to accommodate the light emitting body in the inner space between the package films 6, the light emitting body 1/2/3 is folded down, and has a flat portion and a folded portion. When a bias voltage is applied to the light emitting body, the folded portion emits light as well as the flat portion, and the light is radiated as indicated by arrows in FIG. 6. Although the flat portion radiates the light in the normal direction, the folded portion radiates the light toward the space over the periphery 7, and makes the peripheral area 7 bright.

The fluorescent layer 3 is formed like a sheet, and contains fluorescent substance. The back electrode 1 is, by way of example, formed of aluminum. The back electrode 1 is as wide as the fluorescent layer 3, and the back surface of the fluorescent layer 3 is covered with the back electrode 1. The transparent electrode 2 is formed of transparent conductive material such as, for example, indium tin oxide. The transparent electrode 2 is also as wide as the fluorescent layer 3, and the front surface of the fluorescent layer 3 is covered with the transparent electrode 2. When the light emitting body is installed in the inner space, all of the layers, i.e., the back electrode 1, the transparent electrode 2 and the fluorescent layer 3 are folded down at 180 degrees.

Figure 3:
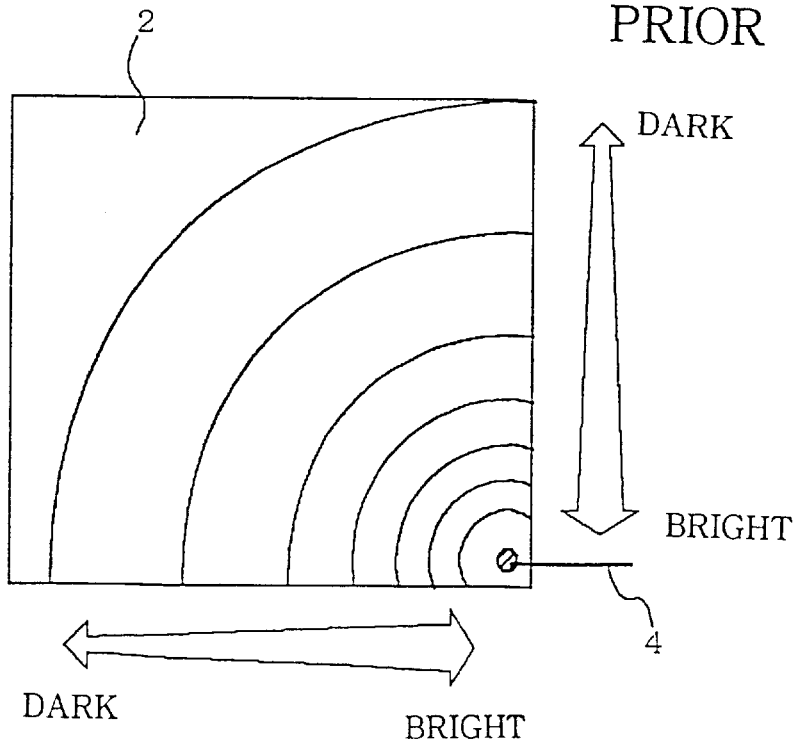
Fig. 3 PRIOR ART
FIG. 3 is a plane view showing the brightness varied over the prior art electroluminescent panel.
Figure 4:
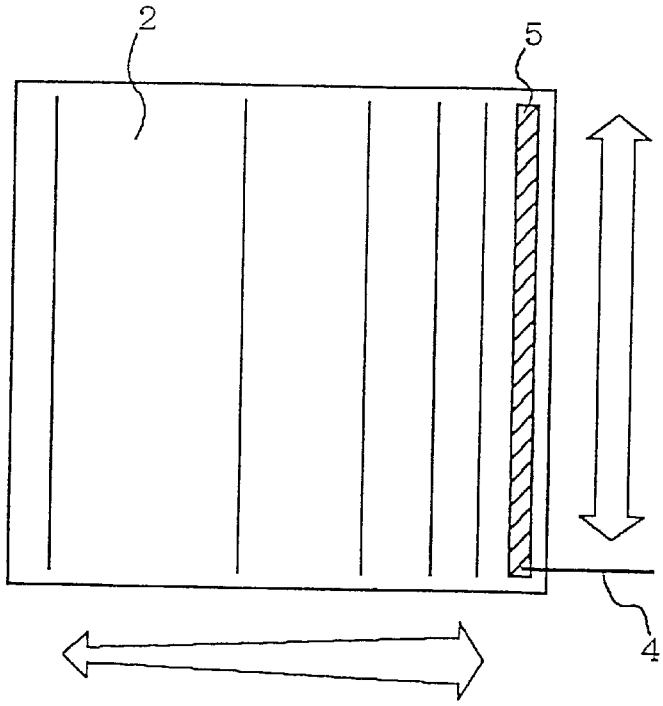
Fig. 4 PRIOR ART
FIG. 4 is a plane view showing another prior art electroluminescent panel.

The power supply system biases the light emitting body with alternating current voltage. The power supply system includes a pair of power supply lines 4 and a non-transparent power feeding layer 5. Silver paste is printed on the transparent electrode 2, and is fired so as to form the non-transparent power feeding layer 5. The non-transparent power feeding layer 5 is formed on the transparent electrode 2 of the folded portion, and is patterned like capital letter "I" (see FIG. 5). In other words, the non-transparent power feeding layer 5 has a stripe shape, and extends along a side line of the light emitting body. The non-transparent power feeding layer 5 makes the potential level uniform along the side line of the folded portion. One of the power supply lines 4 is directly connected to the back electrode 1. The other of the power supply lines 4 is held in contact with the non-transparent power feeding layer 5, and is electrically connected through the non-transparent power feeding layer 5 to the transparent electrode 2. Only the power supply lines 4 project into the inner space, and package films 6 are partially separated for passing the power supply lines 4. However, the package films 6 hermetically seals the light emitting body inside thereof. The alternating current voltage is propagated from the side portion of the folded portion beneath the non-transparent power feeding layer 5 toward the other side line of the transparent electrode 2, and the potential drop is smaller than that in the light emitting body of the prior art electroluminescent panel shown in FIG. 3, because the distance between the side lines is shorter than the distance between two corners.

Light is radiated from the electroluminescent panel according to the present invention as follows. Alternating current voltage is supplied between the transparent electrode 2 and the back electrode 1. The alternating current voltage ranges from 50 volts to 100 volts, and the frequency is fallen within the range between 50 Hz and 1000 Hz. The alternating current voltage creates an alternating electric field across the fluorescent layer 3, and causes the fluorescent layer 3 to emit the light. The light is radiated from the fluorescent layer 3 through the entire surface of the transparent electrode 2. Although any light emitting mean is not inserted between the package films 6 in the peripheral area 7, the light is radiated from the folded portion through the transparent package film 6 toward the space over the peripheral area 7 as indicated by the right arrow in FIG. 6, and makes the space over the peripheral area 7 bright as if the light emitting body is sandwiched between the package films 6 in the peripheral area 7.

In a process for fabricating the electroluminescent panel, the back electrode 1 and the transparent electrode 2 are formed on both surfaces of the fluorescent layer 3, and, thereafter, the non-transparent power feeding layer 5 is patterned on the transparent electrode 2 along the side line. Subsequently, the lamination 1/2/3 is folded along the side line, and the power supply leads 4 are connected to the back electrode 1 and the non-transparent power feeding layer 5. Finally, light emitting body 1/2/3/ is sealed in the inner space between the package films 6.

Otherwise, the non-transparent power feeding layer 5 may be patterned on the transparent electrode 2 of the folded portion after the folding work. When the non-transparent power feeding layer 5 is patterned after the folding work, the non-transparent power feeding layer 5 is exactly located on the transparent electrode 2 of the folded portion.

As will be understood from the foregoing description, the light emitting body per se is folded down, and the light is emitted from the folded portion as well as the flat portion, and the light from the folded portion makes the space over the peripheral area bright. The non-transparent power feeding layer 5 and the back electrode 1 are provided on the same side with respect to the fluorescent layer 3 of the flat portion, and there is not any obstacle against the radiated light on the transparent electrode 2 of the flat portion. This results in that the dark area is substantially eliminated from the electroluminescent panel according to the present invention.

Second Embodiment

Figure 7:
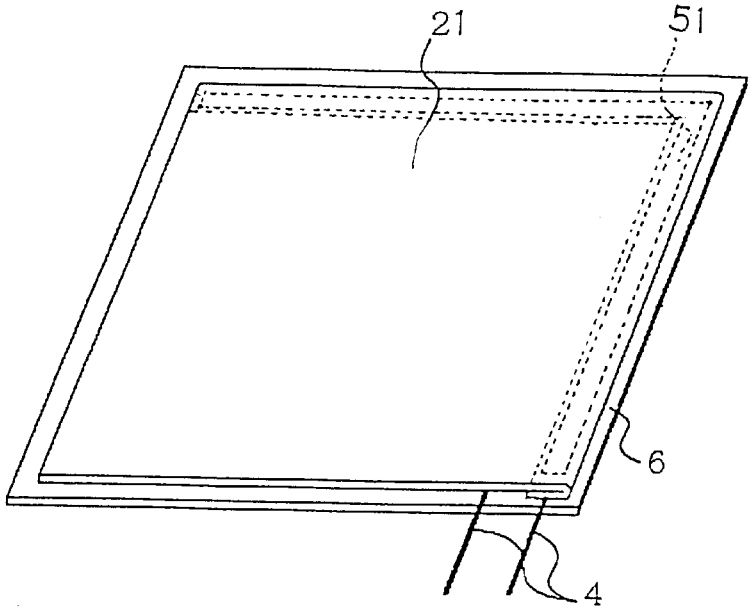
FIG. 7 is a perspective view showing another electroluminescent panel according to the present invention.

Turning to FIG. 7 of the drawings, another electroluminescent panel embodying the present invention also largely comprises a pair of package films 6, a light emitting body 21 and a power supply system 4/51. Although the light emitting body 21 is scaled in an inner space between the package films, the upper package film 6 is removed from the electroluminescent panel shown in FIG. 7. The removal of the upper package film 6 makes the light emitting body 21 clear. The light emitting body 21 is a lamination of a back electrode, a fluorescent layer and a transparent electrode as similar to the first embodiment.

A difference between the light emitting bodies 21 and 1/2/3 is the folded portion. As described hereinbefore, the light emitting body 1/2/3 is folded down along one of the side lines. On the other hand, the light emitting body 21 is folded down along one side line and one end line, and has a flat portion and an L-shaped folded portion. Accordingly, the non-transparent power feeding layer 51 is patterned like capital letter "L", and extends on the folded portion along the side line and the end line. The folded portion of the light emitting body 51 radiates the light toward the space over the L-shaped peripheral area, and makes the space over the L-shaped peripheral area bright. Thus, the electroluminescent panel implementing the second embodiment reduces the dark area. The L-shaped power feeding layer 51 further reduces the potential drop on the transparent electrode, and the gradation of brightness is further improved. The electroluminescent panel implementing the second embodiment is fabricated as similar to the first embodiment.

Third embodiment

Figure 8:
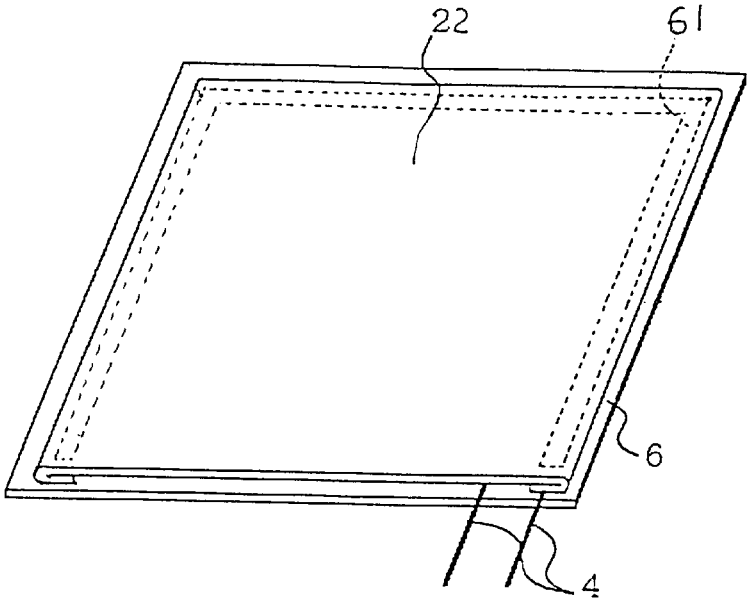
FIG. 8 is a perspective view showing yet another electroluminescent panel according to the present invention.

FIG. 8 illustrates yet another electroluminescent panel embodying the present invention, and the electroluminescent panel implementing the third embodiment also largely comprises a pair of package films 6, a light emitting body 22 and a power supply system 4/61. Although the light emitting body 22 is scaled in an inner space between the package films, the upper package film 6 is removed from the electroluminescent panel shown in FIG. 8. The removal of the upper package film 6 makes the light emitting body 22 clear. The light emitting body 22 is a lamination of a back electrode, a fluorescent layer and a transparent electrode as similar to the first embodiment.

A difference between the light emitting bodies 22 and 1/2/3 is the folded portion. As described hereinbefore, the light emitting body 1/2/3 is only folded down along one of the side lines. On the other hand, the light emitting body 22 is folded down along two side line and one end line, and has a flat portion and a U-shaped folded portion. Accordingly, the non-transparent power feeding layer 61 is patterned like capital letter "U", and extends on the folded portion along the two side lines and the end line. The folded portion of the light emitting body 61 radiates the light toward the space over the U-shaped peripheral area, and makes the space over the U-shaped peripheral area bright. Thus, the electroluminescent panel implementing the second embodiment reduces the dark area. Moreover, the U-shaped power feeding layer 61 reduces the potential drop on the transparent electrode and, accordingly, the gradation of brightness. The electroluminescent panel implementing the third embodiment is fabricated as similar to the first embodiment.

Fourth Embodiment

Figure 9:
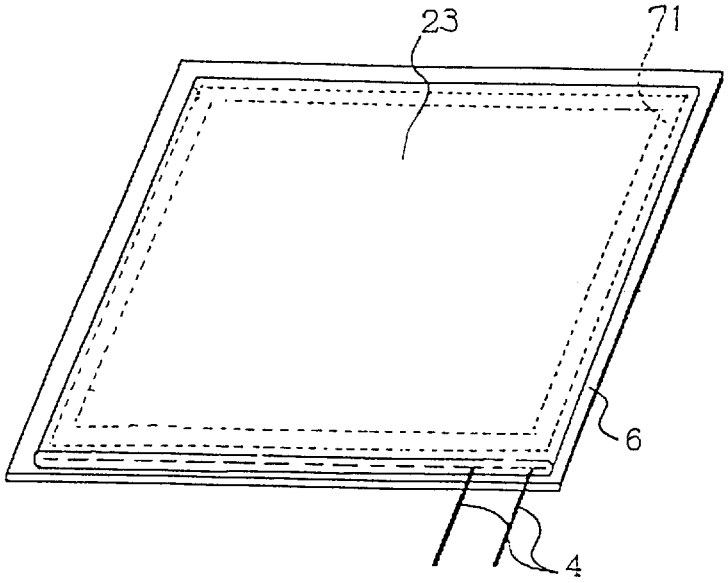
FIG. 9 is a perspective view showing still another electroluminescent panel according to the present invention.

FIG. 9 illustrates still another electroluminescent panel embodying the present invention, and the electroluminescent panel implementing the fourth embodiment also largely comprises a pair of package films 6, a light emitting body 23 and a power supply system 4/71. Although the light emitting body 23 is sealed in an inner space between the package films, the upper package film 6 is removed from the electroluminescent panel shown in FIG. 9. The removal of the upper package film 6 makes the light emitting body 23 clear. The light emitting body 23 is a lamination of a back electrode, a fluorescent layer and a transparent electrode as similar to the first embodiment.

A difference between the light emitting bodies 23 and 1/2/3 is the folded portion. As described hereinbefore, the light emitting body 1/2/3 is only folded down along one of the side lines. On the other hand, the light emitting body 23 is folded down along the entire periphery, i.e., two side lines and two end lines, and has a fiat portion and a looped folded portion. Accordingly, the non-transparent power feeding layer 71 is looped, and extends on the folded portion along the periphery. The folded portion of the light emitting body 71 radiates the light toward the space over the looped peripheral area, and makes the space over the looped peripheral area bright. Thus, the electroluminescent panel implementing the second embodiment perfectly reduces the dark area. Moreover, the U-shaped power feeding layer 71 reduces the potential drop on the transparent electrode and, accordingly, the gradation of brightness. The electroluminescent panel implementing the fourth embodiment is fabricated as similar to the first embodiment.

Fifth Embodiment

Figure 10:
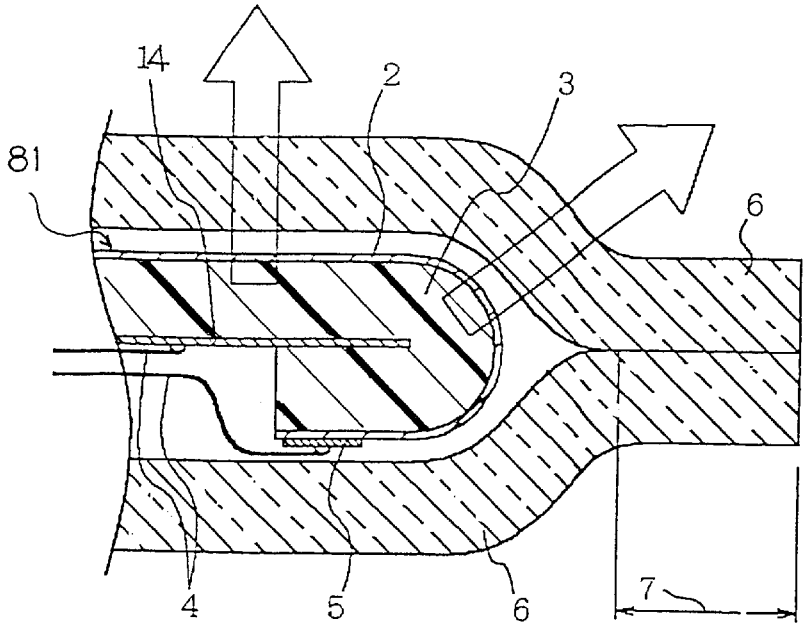
FIG. 10 is a cross sectional view showing yet another electroluminescent panel according to the present invention.
Figure 1:
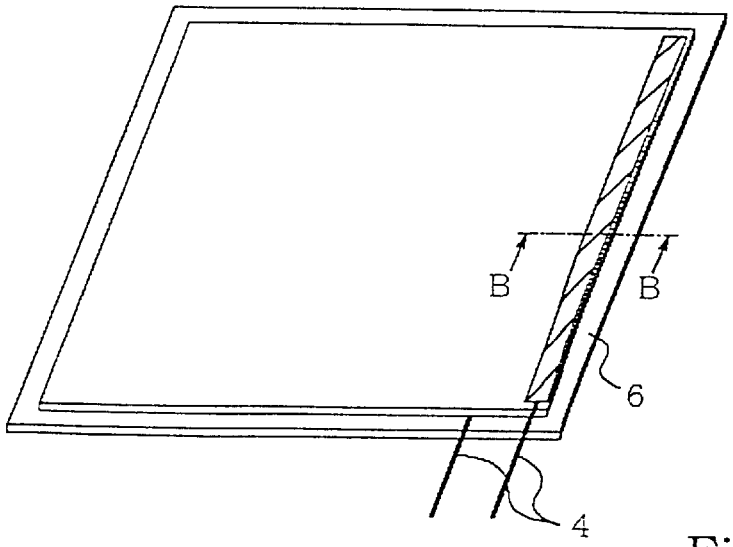
Fig. 1 PRIOR ART
FIG. 1 is a perspective view showing the prior art electroluminescent panel.
Figure 2:
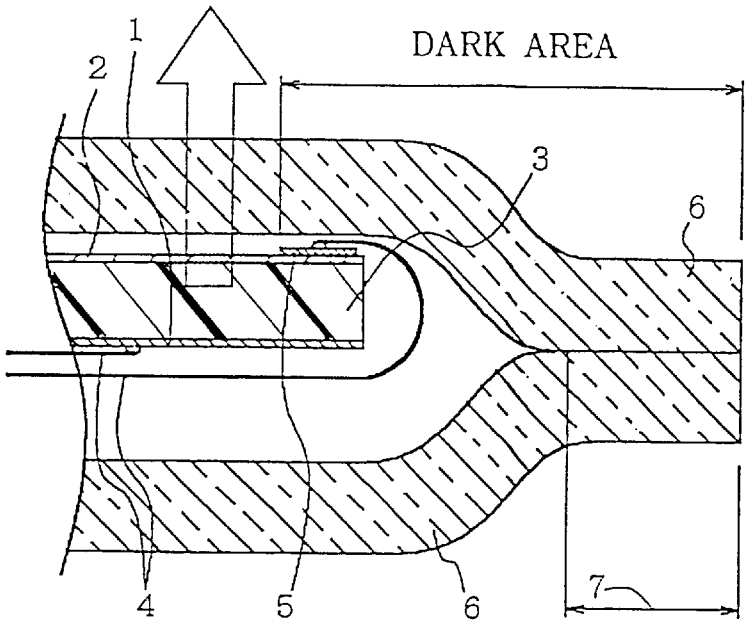
Fig. 2 PRIOR ART
FIG. 2 is a cross sectional view taken along line B—B of FIG. 1 and showing the structure of the prior art electroluminescent panel.

FIG. 10 illustrates yet another electroluminescent panel embodying the present invention. The electroluminescent panel implementing the fifth embodiment also largely comprises a pair of package films 6, a light emitting body 81 and a power supply system 4/5. The light emitting body 81 is sealed in an inner space between the package films 6. The light emitting body 81 includes a back electrode 14, a fluorescent layer 3 and a transparent electrode 2. The light emitting body is folded down along one side line, and the non transparent power feeding layer 5 is patterned like capital letter "I" on the transparent electrode of the folded portion along the side line. The electroluminescent panel implementing the fifth embodiment achieves all the advantages of the first embodiment.

A difference between the light emitting body 1/2/3 and 81 is the back electrode 14. The back electrode 1 is as wide as the transparent electrode 2 and the fluorescent layer 3, and is folded down. The back electrode 1 of the folded portion is laminated on that of the flat portion. This results in increase in thickness of the electroluminescent panel. On the other hand, the back electrode 14 is narrower than the transparent electrode 2 and the fluorescent layer 3. In other words, the back electrode 14 is removed from the folded portion of the light emitting body 81, and the fluorescent layer 3 of the folded portion is directly held in contact with the back electrode 14 of the flat portion. This results in decrease in thickness of the electroluminescent panel. The electroluminescent panel implementing the fifth embodiment is fabricated as similar to the first embodiment.

Sixth Embodiment

Figure 11:
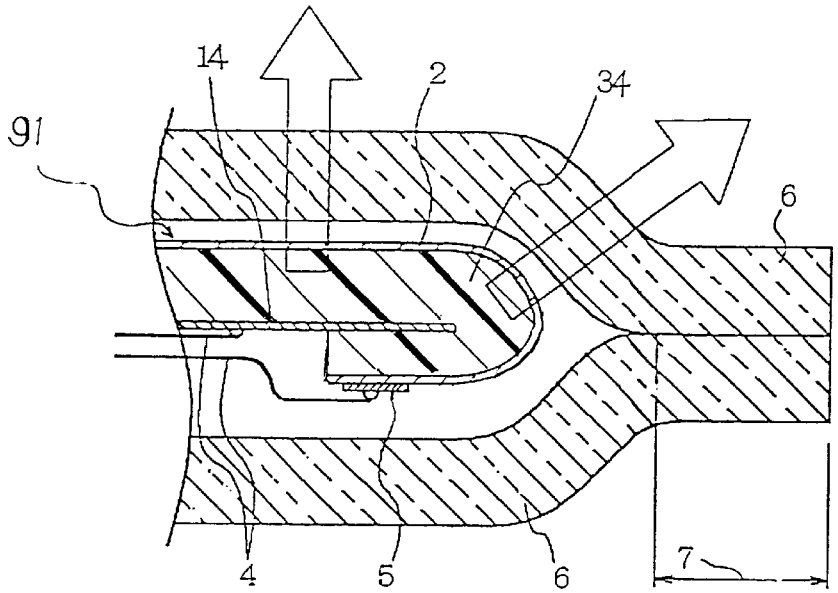
FIG. 11 is a cross sectional view showing still another electroluminescent panel according to the present invention.

FIG. 11 illustrates still another electroluminescent panel embodying the present invention. The electroluminescent panel embodying the present invention largely comprises a pair of package films 6, a light emitting body 91 and a power supply system 4/5. The light emitting body 91 is sealed in an inner space between the package films 6, and is biased through the power supply system 4/5. The light emitting body 91 radiates light toward the space over the peripheral area 7, and the light makes the space over the peripheral area 7 bright.

The light emitting body 91 includes the back electrode 14, the transparent electrode 2 and a fluorescent layer 34. The back electrode 14 is narrower than the transparent electrode 2 and the fluorescent layer 34 as similar to that of the fifth embodiment. The fluorescent layer 34 is partially reduced in thickness. Namely, the fluorescent layer 34 of the flat portion is relatively thick, and the fluorescent layer 34 of the folded portion is relatively thin. When the light emitting body 91 is folded down, the relatively thin fluorescent layer 34 is held in contact with the back electrode 14. The total thickness is further reduced.

The fluorescent layer 34 is desirable for the electroluminescent panels implementing the second, third and fourth embodiments. If the fluorescent layer is constant in thickness, the light emitting body 21/23/24 is increased in thickness at the corner or corners thereof, because the light emitting body 21/23/24 is folded twice at the corner or corners. Even if the fluorescent layer is laminated twice or thrice, the fluorescent layer 34 of the folded portion prevents the corner or corners from increase of thickness. The electroluminescent panel implementing the sixth embodiment is fabricated as similar to the first embodiment.

As will be appreciated from the foregoing description, the electroluminescent panel according to the present invention reduces the dark with the light radiated from the folded portion. Moreover, the non-transparent power feeding layer is patterned on the transparent electrode of the folded portion along one or more than one side line, and the uniformity of brightness is improved.

Lighting Device

Figure 12:
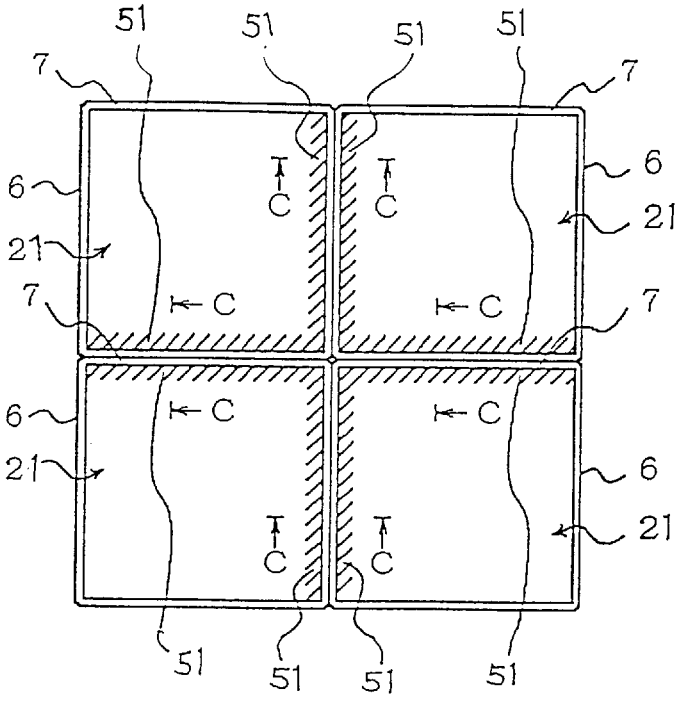
FIG. 12 is a plane view showing a lighting device according to the present invention.
Figure 13:
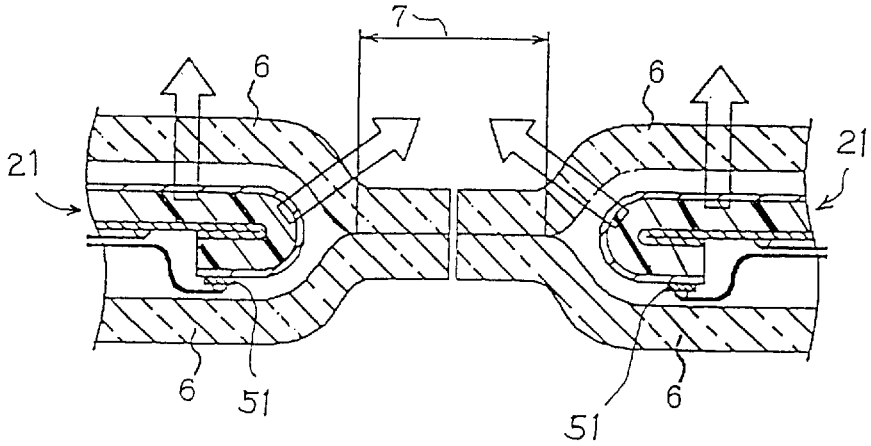
FIG. 13 is a cross sectional view taken along line C—C of FIG. 12 and showing the structure of the lighting device.

The electroluminescent panels are arranged in matrix for forming a lighting device appropriate for a panel display as shown in FIGS. 12 and 13. Any one of the electroluminescent panels shown in FIGS. 5 to 11 is available for the lighting device. In this instance, the electroluminescent panel implementing the second embodiment is used for the lighting device.

Plural electroluminescent panels are arranged in matrix for forming the light device. The upper package films 6 are removed from the electroluminescent panels so as to clearly show the light emitting bodies 21. The array of plural electroluminescent panels measures 250 millimeters by 250 millimeters. However, it is possible to form a lighting device wider than that shown in FIG. 12.

Each of the electroluminescent panels has the L-shaped non-transparent power feeding layer 51 on the folded portion of the light emitting body 21. The electroluminescent panels are arranged in such a manner that each of the L-shaped non-transparent power feeding layers 51 is opposed to those of the adjacent L-shaped non-transparent power feeding layers 51. The location of the L-shaped non-transparent power feeding layers 51 are indicated by hatching lines in FIG. 12, and the L-shaped non-transparent power feeding layers 51 form a large cross. Accordingly, the folded portions of the light emitting bodies 51 are located like the large cross.

When the light emitting bodies 21 are biased with the alternating current voltage, light is emitted from the folded portions of the light emitting bodies 21 as well as the flat portions thereof (see FIG. 13). The folded portions illuminate the space over the peripheral areas, and the lighting device makes the entire surface thereof bright without any dark area. The lighting device is appropriate for a display panel such as, for example, a liquid crystal display panel.

As will be understood, the electroluminescent panel according to the present invention is available for a wide lighting device uniform in brightness.

Although particular embodiments of the present invention have been shown and described, it will be apparent to those skilled in the art that various changes and modifications may be made without departing from the spirit and scope of the present invention. For example, an electroluminescent panel according to the present invention may be biased with direct current voltage. The transparent electrode 2 may be patterned into a certain image.

A light emitting body is partially cut away at the corner or corners before being folded. In this instance, there is not any corner folded twice. For this reason, the electroluminescent panel is constant in thickness along the periphery thereof.

What is claimed is:

1. An electroluminescent panel comprising a package having an inner space, a light emitting body accommodated in said inner space and including a fluorescent layer for emitting light, a high-conductive non-transparent electrode formed on one major surface of said fluorescent layer and a low-conductive transparent electrode formed on the other major surface of said fluorescent layer, at least a part of said fluorescent layer and an associated part of said low-conductive transparent electrode extending beyond an edge of said high-conductive non-transparent electrode and being folded so as to overlap said edge therewith, and a power supply system including a first power supply lead connected to said high-conductive non-transparent electrode, a high-conductive power feeding layer formed on said associated part of said low-conductive transparent electrode and a second power supply lead connected to said high-conductive power feeding layer, said high-conductive power feeding layer being substantially parallel to said edge and extending over said low-conductive transparent electrode for a distance substantially equal to the length of said edge, in which said package has a sealing portion, and said associated part of said low-conductive transparent electrode is opposed to said sealing portion so that part of said light is radiated from said part of said fluorescent layer through said associated part of said low-conductive transparent electrode toward a space around said sealing portion, and in which said sealing portion is bent at right angles thrice, and said part of said fluorescent layer, said associated part of said low-conductive transparent electrode and said high-conductive power feeding layer are bent at right angles thrice.

2. An electroluminescent panel comprising a package having an inner space, a light emitting body accommodated in said inner space and including a fluorescent layer for emitting light, a high-conductive non-transparent electrode formed on one major surface of said fluorescent layer and a low-conductive transparent electrode formed on the other major surface of said fluorescent layer, at least a part of said fluorescent layer and an associated part of said low-conductive transparent electrode extending beyond an edge of said high-conductive non-transparent electrode and being folded so as to overlap said edge therewith, and a power supply system including a first power supply lead connected to said high-conductive non-transparent electrode, a high-conductive power feeding layer formed on said associated part of said low-conductive transparent electrode and a second power supply lead connected to said high-conductive power feeding layer, said high-conductive power feeding layer being substantially parallel to said edge and extending over said low-conductive transparent electrode for a distance substantially equal to the length of said edge, in which said package has a sealing portion, and said associated part of said low-conductive transparent electrode is opposed to said sealing portion so that part of said light is radiated from said part of said fluorescent layer through said associated part of said low-conductive transparent electrode toward a space around said sealing portion, and in which said sealing portion is looped along a periphery of said package, and said part of said fluorescent layer, said associated part of said low-conductive transparent electrode and said high-conductive power feeding layer are looped along a periphery of said light emitting body.

3. An electroluminescent panel comprising a package having an inner space, a light emitting body accommodated in said inner space and including a fluorescent layer for emitting light, a high-conductive non-transparent electrode formed on one major surface of said fluorescent layer and a low-conductive transparent electrode formed on the other major surface of said fluorescent layer, at least a part of said fluorescent layer and an associated part of said low-conductive transparent electrode extending beyond an edge of said high-conductive non-transparent electrode and being folded so as to overlap said edge therewith, and a power supply system including a first power supply lead connected to said high-conductive non-transparent electrode, a high-conductive power feeding layer formed on said associated part of said low-conductive transparent electrode and a second power supply lead connected to said high-conductive power feeding layer, said high-conductive power feeding layer being substantially parallel to said edge and extending over said low-conductive transparent electrode for a distance substantially equal to the length of said edge, in which said light emitting body has a generally rectangular parallelepiped configuration, and said part of said fluorescent layer, said associated part of said low-conductive transparent electrode are folded along the periphery of said generally rectangular parallelepiped configuration so that said high-conductive power feeding layer is looped along said periphery.

4. An electroluminescent panel comprising a package having an inner space, a light emitting body accommodated in said inner space and including a fluorescent layer for emitting light, a high-conductive non-transparent electrode formed on one major surface of said fluorescent layer and a low-conductive transparent electrode formed on the other major surface of said fluorescent layer, at least a part of said fluorescent layer and an associated part of said low-conductive transparent electrode extending beyond an edge of said high-conductive non-transparent electrode and being folded so as to overlap said edge therewith, and a power supply system including a first power supply lead connected to said high-conductive non-transparent electrode, a high-conductive power feeding layer formed on said associated part of said low-conductive transparent electrode and a second power supply lead connected to said high-conductive power feeding layer, said high-conductive power feeding layer being substantially parallel to said edge and extending over said low-conductive transparent electrode for a distance substantially equal to the length of said edge, wherein a portion of said fluorescent layer overlapping the edge and in proximity to the high-conductive power feeding layer is reduced in thickness from a major portion of said fluorescent layer.

5. A lighting device comprising plural electroluminescent panels for providing a light emitting surface, each of said electroluminescent panels comprising a package having an inner space, a light emitting body accommodated in said inner space and including a fluorescent layer for emitting light, a high-conductive non-transparent electrode formed on one major surface of said fluorescent layer and a low-conductive transparent electrode formed on the other major surface of said fluorescent layer, at least a part of said fluorescent layer and an associated part of said low-conductive transparent electrode extending beyond an edge of said high-conductive non-transparent electrode and being folded so as to overlap said edge therewith, and a power supply system including a first power supply lead connected to said high-conductive non-transparent electrode, a high-conductive power feeding layer formed on said associated part of said low-conductive transparent electrode and a second power supply lead connected to said high-conductive power feeding layer, said high-conductive power feeding layer being substantially parallel to said edge and extending over said low-conductive transparent electrode for a distance substantially equal to the length of said edge, wherein a portion of said fluorescent layer overlapping the edge and in proximity to the high-conductive power feeding layer is reduced in thickness from a major portion of said fluorescent layer.

* * * * *